US009463481B2

(12) United States Patent
Peng et al.

(10) Patent No.: US 9,463,481 B2
(45) Date of Patent: Oct. 11, 2016

(54) THERMAL SPRAYING APPARATUS AND THERMAL SPRAYING SYSTEM

(71) Applicant: TAIWAN TEXTILE RESEARCH INSTITUTE, New Taipei (TW)

(72) Inventors: Chao-Chun Peng, New Taipei (TW); Ming-Chih Kuo, New Taipei (TW)

(73) Assignee: TAIWAN TEXTILE RESESARCH INSTITUTE, New Taipei (TW)

( * ) Notice: Subject to any disclaimer, the term of this patent is extended or adjusted under 35 U.S.C. 154(b) by 0 days.

(21) Appl. No.: 14/737,415

(22) Filed: Jun. 11, 2015

(65) Prior Publication Data

US 2015/0367361 A1 Dec. 24, 2015

(30) Foreign Application Priority Data

Jun. 19, 2014 (TW) ..... 103121185 A
May 15, 2015 (TW) ..... 104115623 A

(51) Int. Cl.
*B05B 1/24* (2006.01)
*B05B 7/16* (2006.01)
*B05B 7/14* (2006.01)

(52) U.S. Cl.
CPC ..... *B05B 7/1693* (2013.01); *B05B 7/144* (2013.01)

(58) Field of Classification Search
CPC ... B05B 7/1626; B05B 7/1693; B05B 7/144; B05B 7/208; B05B 7/205
USPC ..... 239/133, 134, 128, 89, 91
See application file for complete search history.

(56) References Cited

U.S. PATENT DOCUMENTS 2,976,392 A * 3/1961 Wabnitz ..... B05B 1/3046 239/128
3,722,821 A * 3/1973 Jaeger ..... C04B 35/486 239/133
4,635,851 A * 1/1987 Zecman ..... B22D 17/2038 222/593
4,669,661 A * 6/1987 Otto ..... B05B 7/1613 239/132.1
8,088,315 B2 1/2012 Torres et al.
8,124,549 B2 2/2012 Torres et al.
2006/0269639 A1 11/2006 Bortoli
2008/0041979 A1 2/2008 Gardega
2010/0286583 A1 11/2010 Torres et al.

FOREIGN PATENT DOCUMENTS

CN 1868724 A 11/2006
CN 100434190 C 11/2008
CN 101462095 A 6/2009

* cited by examiner

*Primary Examiner* — Davis Hwu
(74) *Attorney, Agent, or Firm* — McClure, Qualey & Rodack, LLP

(57) ABSTRACT

A thermal spraying apparatus includes a hollow pipe, an extrusion die, a piston, a helical pipe, a fluid supplying device, and a heater. The hollow pipe defines an accommodating space for accommodating a raw material. The extrusion die is connected with the hollow pipe. The extrusion die has a nozzle. The nozzle is in spatial communication with the accommodating space. The piston is movably accommodated in the accommodating space to push the raw material to pass through the nozzle. The hollow pipe is surrounded by the helical pipe. An end of the helical pipe is connected to the nozzle. The fluid supplying device is connected to another end of the helical pipe. The heater encloses the helical pipe and the hollow pipe for heating the helical pipe and the accommodating space.

11 Claims, 16 Drawing Sheets

100

THERMAL SPRAYING APPARATUS AND THERMAL SPRAYING SYSTEM

RELATED APPLICATIONS

This application claims priority to Taiwan Application Serial Number 103121185, filed Jun. 19, 2014, and Taiwan Application Serial Number 104115623, filed May 15, 2015, which are herein incorporated by reference.

BACKGROUND

1. Technical Field

Embodiments of the present invention relate to a thermal spraying apparatus.

2. Description of Related Art

Traditional fusion spraying apparatus generally utilizes a guide screw as an extrusion system, which renders the overall apparatus too bulky. Hence, the fusion spraying apparatus can only be fixed during a fusion spraying operation. As a result, the operator has a limited flexibility when operating the fusion spraying apparatus, thus affecting the textile design flexibility.

In addition, although there are manufacturers who have developed a blow gun using solvent, adhesive, and short fiber as raw materials. Such kind of blow gun is convenient to operate, but however, the blow gun nozzle is easily blocked and the solvent can easily cause a fire and is harmful to health. At the same time, because the raw materials of the blow gun need to be specially prepared, they are not compatible with the prior art raw material, which in turn limits the commercial value.

For the forgoing reasons, there is a need to solve the above-mentioned problem by providing a thermal spraying apparatus.

SUMMARY

An embodiment of the present invention provides a thermal spraying apparatus. The thermal spraying apparatus includes a hollow pipe, an extrusion die, a piston, a helical pipe, a fluid supplying device, and a heater. The hollow pipe defines an accommodating space in the hollow pipe. The accommodating space is configured to accommodate a raw material. The extrusion die is connected with the hollow pipe. The extrusion die has a nozzle. The nozzle is in spatial communication with the accommodating space. The piston is movably accommodated in the accommodating space to push the raw material to pass through the nozzle. The helical pipe surrounds the hollow pipe. An end of the helical pipe is connected to the nozzle. The fluid supplying device is connected to another end of the helical pipe. The heater encloses the helical pipe and the hollow pipe for heating the helical pipe and the accommodating space.

An embodiment of the invention provides a thermal spraying system. The thermal spraying system includes a fixing device, a thermal spraying apparatus, and a motion module. The fixing device is for fixing an object to be thermally sprayed. The thermal spraying apparatus is for performing a thermal spraying operation to the object to be thermally sprayed. The motion module is for driving a relative motion between the thermal spraying apparatus and the fixing device.

According to the above embodiments, the thermal spraying apparatus can be operated by itself in the handheld manner, or can cooperate with three-dimensional thermal spraying technology to form a thermal spraying system. The thermal spraying system utilizing the thermal spraying apparatus has the advantage of lightweight, which does not result in an excessive burden of the thermal spraying motion device so as to effectively extend the service life of the thermal spraying motion device. The present invention thermal spraying apparatus utilizes the piston instead of the prior art screw guide to push the raw material. In addition, since the present invention can utilize the prior art raw material without the necessity of preparing solvent, occupational accidents therefore do not happen to designers and the raw material cost is cheaper. In summary, the present invention thermal spraying apparatus is very light, which allows designers to flexibly design the products in the handheld manner for an extended period of time.

It is to be understood that both the foregoing general description and the following detailed description are by examples, and are intended to provide further explanation of the invention as claimed.

BRIEF DESCRIPTION OF THE DRAWINGS

The accompanying drawings are included to provide a further understanding of the invention, and are incorporated in and constitute a part of this specification. The drawings illustrate embodiments of the invention and, together with the description, serve to explain the principles of the invention. In the drawings.

DESCRIPTION OF THE EMBODIMENTS

In the following detailed description, for purposes of explanation, numerous specific details are set forth in order to provide a thorough understanding of the disclosed embodiments. It will be apparent, however, that one or more embodiments may be practiced without these specific details. In other instances, well-known structures and devices are schematically depicted in order to simplify the drawings.

First Embodiment

Figure 1:
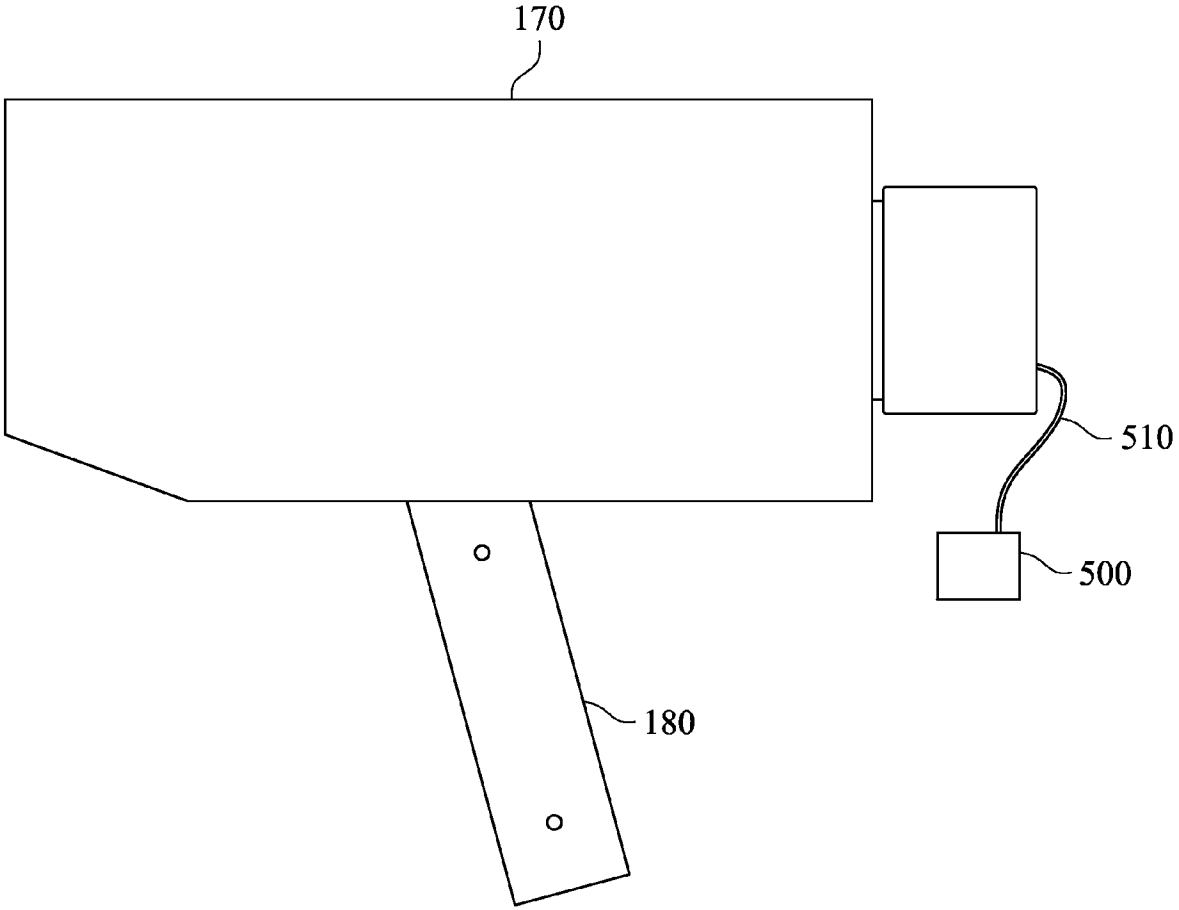
FIG. 1 is a side view of a thermal spraying apparatus according to a first embodiment of this invention.
Figure 2:
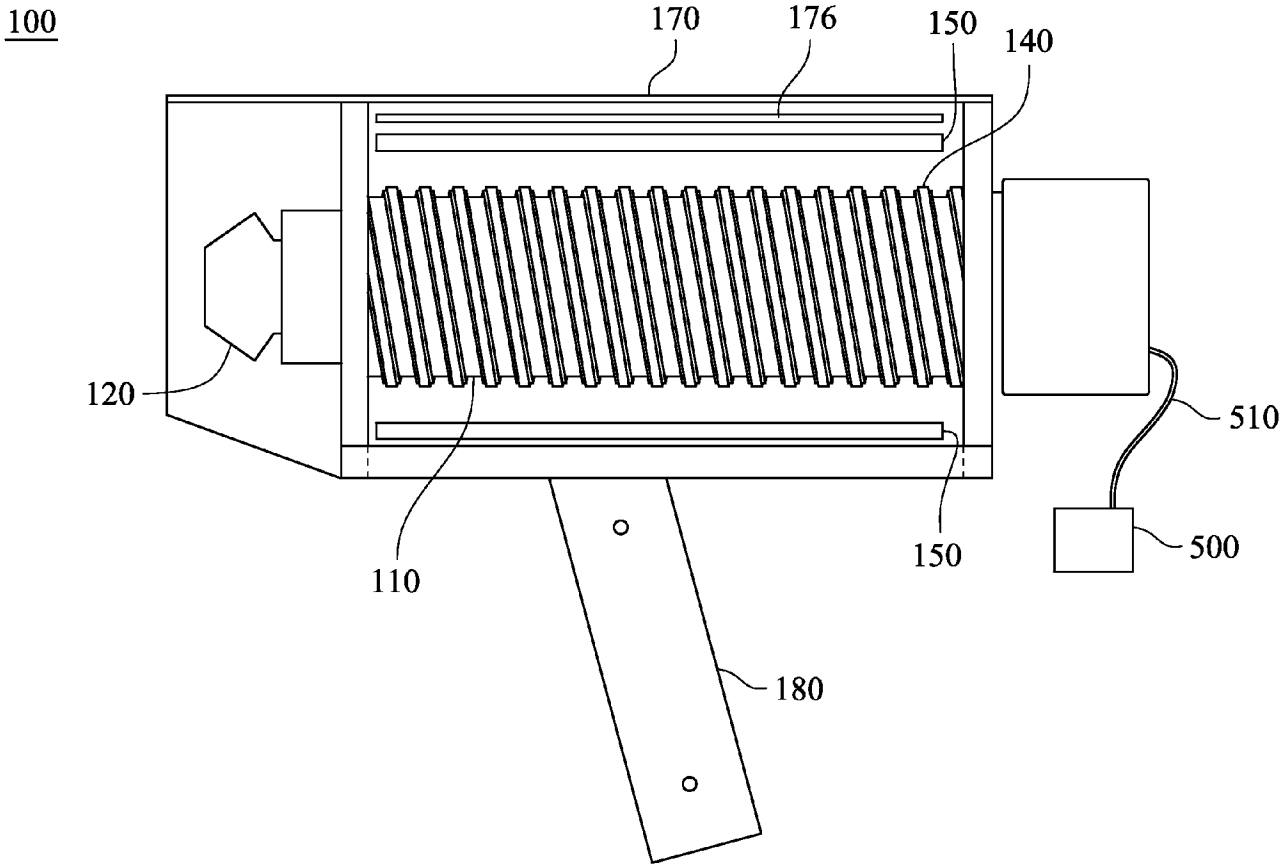
FIG. 2 is a perspective view of the thermal spraying apparatus in FIG. 1.
Figure 3:
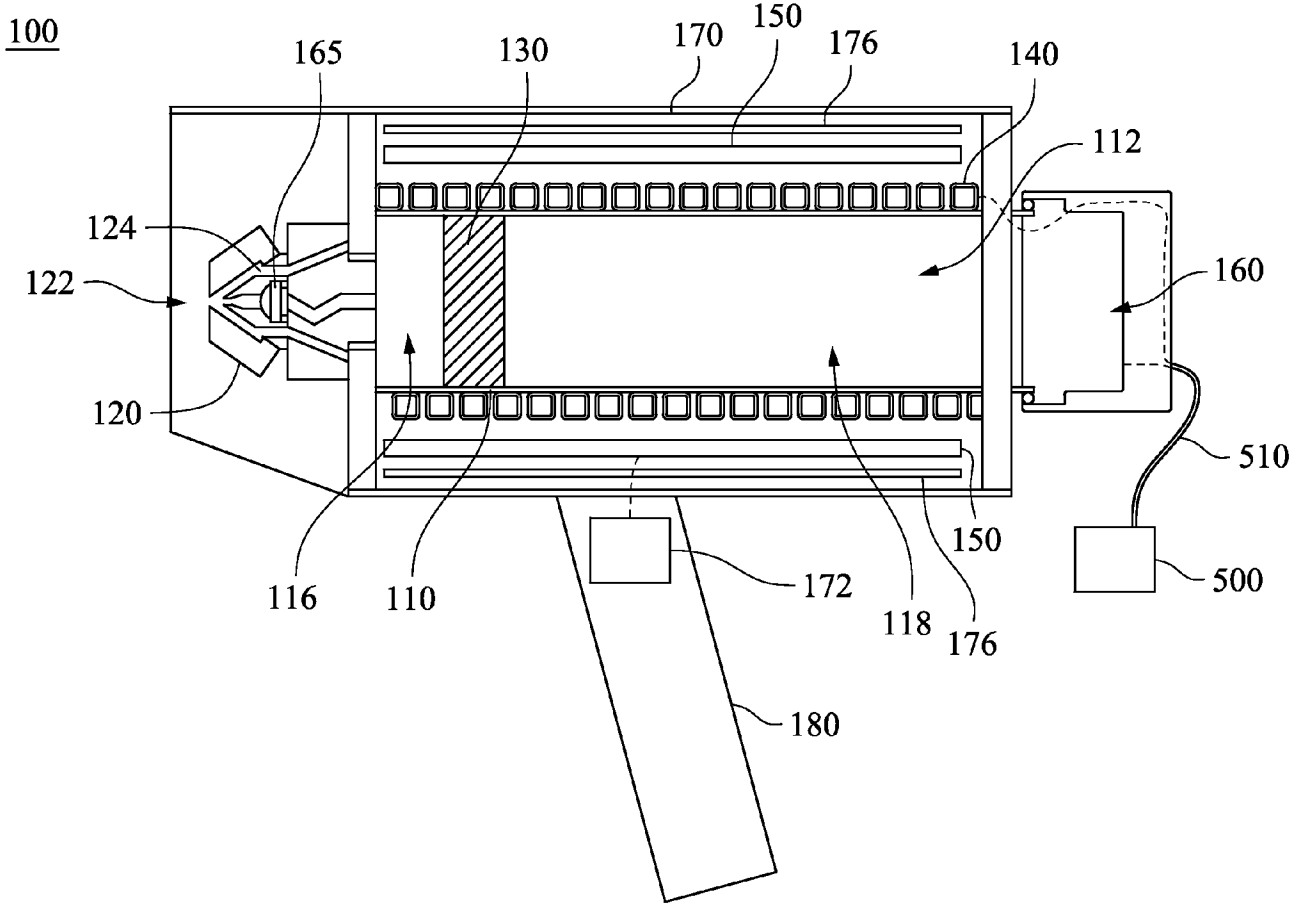
FIG. 3 is a cross-sectional view of the thermal spraying apparatus in FIG. 1.

In order to solve the problem that the prior art fusion spraying apparatus is too bulky, which in turn limits the location where the fusion spraying apparatus can be used and makes the fusion spraying apparatus not portable, and also eliminate the health concern and safety concern of the blow gun, a thermal spraying apparatus is provided according to a first embodiment of the present invention. FIG. 1 is a side view of a thermal spraying apparatus 100 according to a first embodiment of this invention. FIG. 2 is a perspective view of the thermal spraying apparatus 100 in FIG. 1. FIG. 3 is a cross-sectional view of the thermal spraying apparatus 100 in FIG. 1. As shown in FIG. 1 to FIG. 3, the thermal spraying apparatus 100 includes a hollow pipe 110, an extrusion die 120, a piston 130, a helical pipe 140, a heater 150, and a fluid supplying device 500. The hollow pipe 110 defines an accommodating space 112 therein. The accommodating space 112 is configured to accommodate a raw material. The extrusion die 120 is connected with the hollow pipe 110. The extrusion die 120 has a nozzle 122. The nozzle 122 is in spatial communication with the accommodating space 112. The piston 130 is movably accommodated in the accommodating space 112 to push the raw material to pass through the nozzle 122. The hollow pipe 110 is surrounded by the helical pipe 140. An end of the helical pipe 140 is connected to the nozzle 122 via auxiliary airflow passages 124. The fluid supplying device 500 is connected with another end of the helical pipe 140 via a pipe 510. The heater 150 encloses the helical pipe 140 and the hollow pipe 110 and is configured to heat the helical pipe 140 and the accommodating space 112.

According to the present embodiment, the thermal spraying apparatus 100 includes a propulsion passage 160. The accommodating space 112 is divided into a front part 116 closer to the nozzle 122 and a back part 118 farther from the nozzle 122 by the piston 130. An end of the propulsion passage 160 is connected to the fluid supplying device 500 via the pipe 510. Another end of the propulsion passage 160 is in spatial communication with the back part 118 so that fluid provided by the fluid supplying device 500 is able to push the piston 130 to move toward the nozzle 122.

In the present embodiment, the thermal spraying apparatus 100 is connected to the fluid supplying device 500 via the single pipe 510, and the fluid is then separately guided into the propulsion passage 160 and the helical pipe 140 in the thermal spraying apparatus 100. In this manner, inconvenience of using the thermal spraying apparatus 100 because of complexity caused by multiple pipes is avoided. However, the present invention is not limited in this regard. In some embodiments of the present invention, one pair of pipes may be utilized to respectively connect the propulsion passage 160 and the helical pipe 140 to the fluid supplying device 500.

When a designer uses the thermal spraying apparatus 100 in a handheld manner, the raw material can be placed into the front part 116. At this time, the fluid provided by the fluid supplying device 500 pushes the piston 130 to move toward the nozzle 122 so that the piston 130 pushes the raw material to move toward the nozzle 122. The raw material in the hollow pipe 110 is heated by the heater 150. Hence, the raw material will gradually melt. In addition to that, a temperature of the fluid in the helical pipe 140 is increased because the fluid in the helical pipe 140 is also heated by the heater 150. When the heated fluid is sprayed from the nozzle 122, the molten raw material will be carried and sprayed out with the heated fluid so as to form a thermal spraying textile. According to the present embodiment, the fluid in the helical pipe 140 is heated to raise the temperature of the fluid. Thus, blockage to the nozzle 122 resulting from solidification of the raw material due to cooling when the raw material is sprayed out is avoided.

When the heater 150 performs heating, the fluid in the helical pipe 140 carries thermal energy to a position of the hollow pipe 110 close to the extrusion die 120, such that a temperature inside the hollow pipe 110 gradually increases from a position far from the extrusion die 120 to a position close to the extrusion die 120. Such a configuration allows a user's handheld position and an inlet of the hollow pipe 110 away from the extrusion die 120 to be maintained at relative low temperatures, which facilitates users to operate or fill the raw material.

According to one embodiment of the present invention, a total length of the hollow pipe 110 is 233 millimeters (mms). A temperature of the heater 150 is set to be 200° C. A material of the raw material is polypropylene (PP). At a position 78-233 millimeters from the extrusion die 120, a temperature of the raw material is only 75° C. and the raw material has not yet melted. At a position 39-78 millimeters from the extrusion die 120, the temperature of the raw material is increased to 160° C. and the raw material has melted to become a fluid having a viscosity higher than 100 poise. At a position 0-39 millimeters from the extrusion die 120, the temperature of the raw material is further increased to 200° C. and the raw material has melted to become a fluid having a viscosity ranging from 10 poise to 21 poise.

According to another embodiment of the present invention, the total length of the hollow pipe 110 is 233 millimeters. The temperature of the heater 150 is set to be 230° C. The material of the raw material is thermoplastic polyurethane (TPU). At the position 78-233 millimeters from the extrusion die 120, the temperature of the raw material is only 100° C. and the raw material has not yet melted. At the position 39-78 millimeters from the extrusion die 120, the temperature of the raw material is increased to 180° C. and the raw material has melted to become a fluid having a viscosity higher than 100 poise. At the position 0-39 millimeters from the extrusion die 120, the temperature of the raw material is further increased to 230° C. and the raw material has melted to become a fluid having a viscosity ranging from 10 poise to 21 poise.

In the present embodiment, the fluid supplying device 500 may be an air compressor. Airflow provided by the air compressor can pass through the pipe 510 and the propulsion passage 160 to push the piston 130 to move toward the nozzle 122. In addition, the airflow provided by the air compressor can pass through the pipe 510, the helical pipe 140, and the auxiliary airflow passages 124, thereby reaching the nozzle 122 to carry the molten raw material to be sprayed out.

It is noted that the above-mentioned fluid supplying device 500 is not limited to the air compressor. An air package or other device being able to provide fluid with a thrust force can also serve as the fluid supplying device 500.

Those of ordinary skill of the art may flexibly select the adequate fluid supplying device 500 depending on practical needs.

In order to control the spraying action of the raw material, the present invention thermal spraying apparatus 100 further includes a switching valve 165. The switching valve 165 is connected between the accommodating space 112 and the nozzle 122. When the switching valve 165 is turned on, the raw material can be transported from the accommodating space 112 to the nozzle 122 via the switching valve 165. When the switching valve 165 is turned off, the raw material can not be transported to the nozzle 122 via the switching valve 165. As such, users can control whether the nozzle 122 sprays the raw material by controlling the switching valve 165. In practical applications, the above switching valve 165 may be an electric control switching valve and/or a pneumatic switching valve.

According to the present embodiment, the thermal spraying apparatus 100 includes a housing 170 and a handheld grip 180. The housing 170 at least encloses the hollow pipe 110, the helical pipe 140, and the heater 150. The handheld grip 180 is connected to the housing 170. The housing 170 is configured to protect interior devices. The handheld grip 180 is convenient for a designer to hold.

Additionally, the housing 170 according to the present embodiment may further extend to surround the nozzle 122 so as to serve as a shield. The impact of splash on surroundings is thus avoided. In the present embodiment, the shield is one part of the housing 170. However, in other embodiments, the shield may be an element independent of the housing 170, and the housing 170 and the shield are detachably connected. Those of ordinary skill of the art may flexibly select a configuration depending on practical needs.

In the present embodiment, the thermal spraying apparatus 100 may further include a temperature controller. For example, the temperature controller may a built-in temperature controller 172. The built-in temperature controller 172 is electrically connected to the heater 150 for controlling a temperature of the heater 150. In greater detail, the built-in temperature controller 172 according to the present embodiment may be located on the housing 170 or inside the handheld grip 180. When the built-in temperature controller 172 detects that the temperature will soon be unduly high, it will actively control the heater 150 to stop raising temperature. When the built-in temperature controller 172 detects that the temperature will soon be unduly low, it will actively control the heater 150 to raise temperature.

According to the present embodiment, the raw material may be a rod-shaped raw material matching with a size of the accommodating space 112. Since no air exists in the rod-shaped raw material, the intermittent and unsmooth spraying because of the presence of air can be prevented when the raw material is sprayed from the nozzle 122.

As shown in FIG. 3, the thermal spraying apparatus 100 may further include a heat-insulating element 176 in the present embodiment. The heat-insulating element 176 encloses the heater 150, the helical pipe 140, and the hollow pipe 110. By enclosing the heater 150 with the heat-insulating element 176, not only the heat energy leakage does not occur, but the designer also does not get burned due to high temperature.

Second Embodiment

Figure 4:
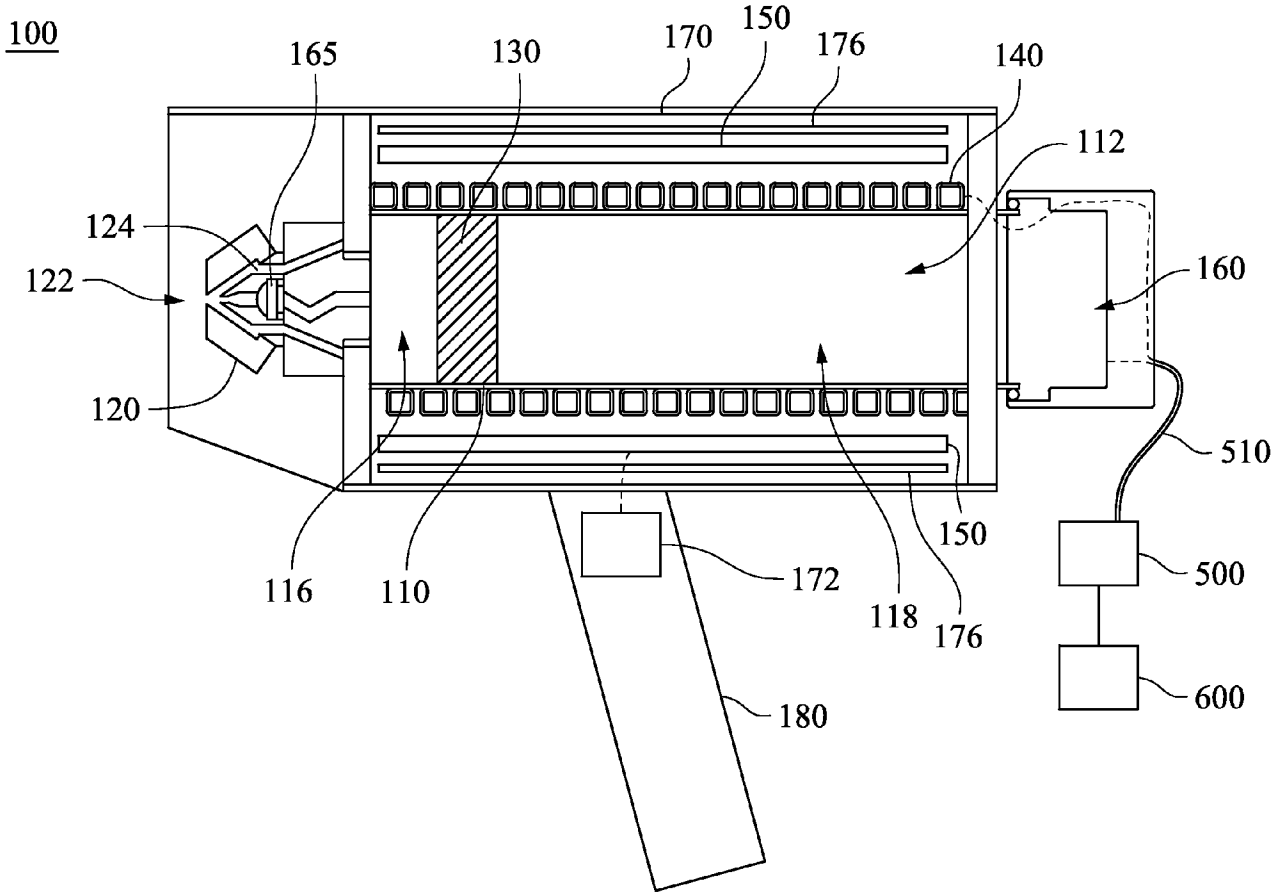
FIG. 4 is a cross-sectional view of a thermal spraying apparatus according to a second embodiment of this invention.

FIG. 4 is a cross-sectional view of a thermal spraying apparatus 100 according to a second embodiment of this invention. The major difference between the present embodiment and the first embodiment is that the thermal spraying apparatus 100 according to the present embodiment further includes a pressure controller 600. The pressure controller 600 is connected to the fluid supplying device 500 for controlling a pressure of the fluid supplied by the fluid supplying device 500. Hence, the closer the piston 130 is to the nozzle 122, the lower pressure the fluid has. As a result, even though the closer the piston 130 is to the nozzle 122, the less amount of the raw material is in the front part 116, which possibly causes a moving speed of the piston 130 to increase, however, the tendency of increasing moving speed of the piston 130 is effectively suppressed because the piston 130 is pushed by a reduced fluid pressure. The uneven extrusion speed of the raw material caused by the increasing moving speed of the piston 130, which in turn impacts the thermal spraying effect, is prevented. For example, the pressure controller 600 may be a pressure valve. The pressure valve is disposed on the fluid supplying device 500 or the pipe 510 to control the fluid pressure.

Since other relevant structures and operation details are the same as those of the first embodiment, a description in this regard is not provided.

Third Embodiment

Figure 5:
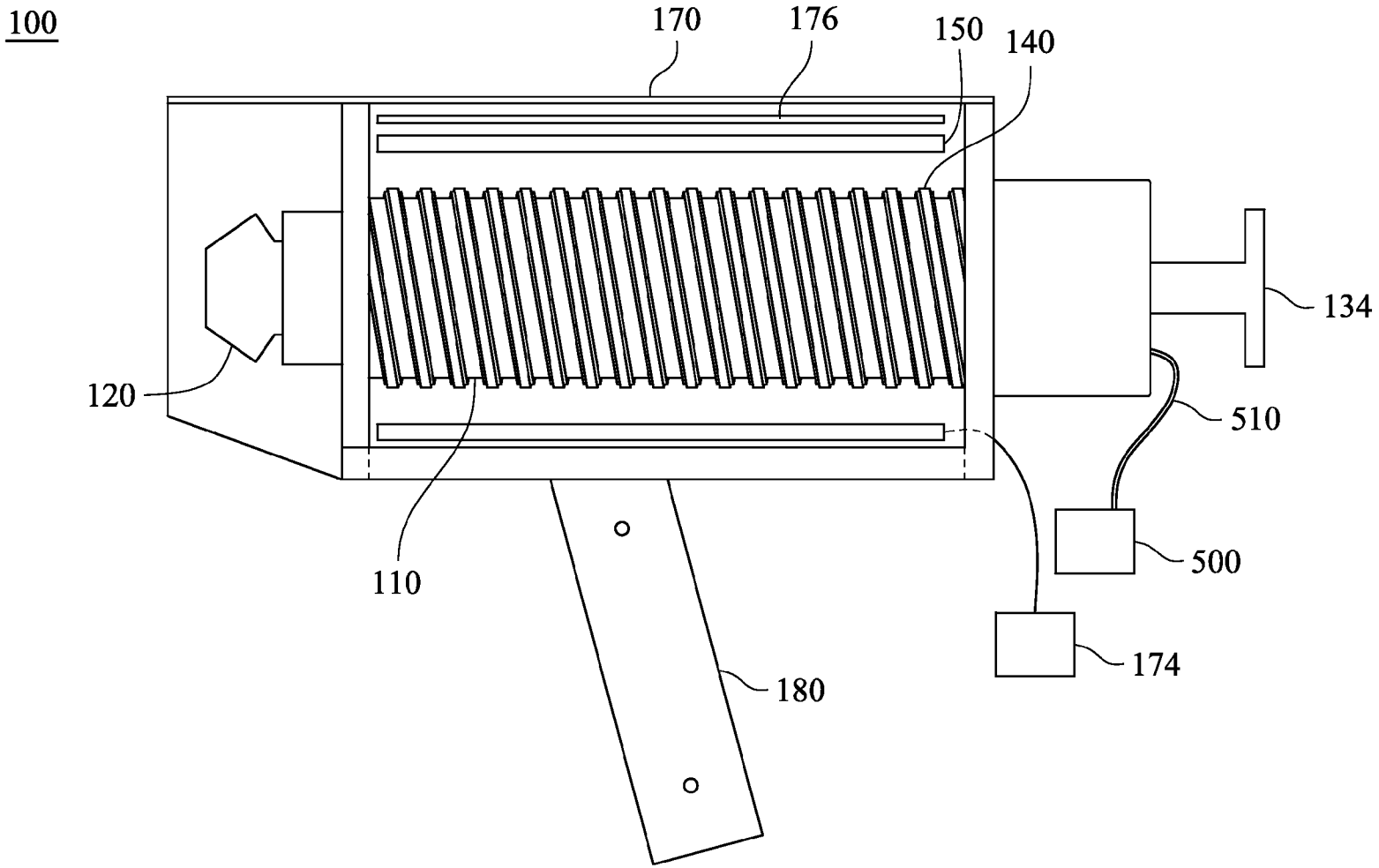
FIG. 5 is a perspective view of a thermal spraying apparatus according to a third embodiment of this invention.
Figure 6:
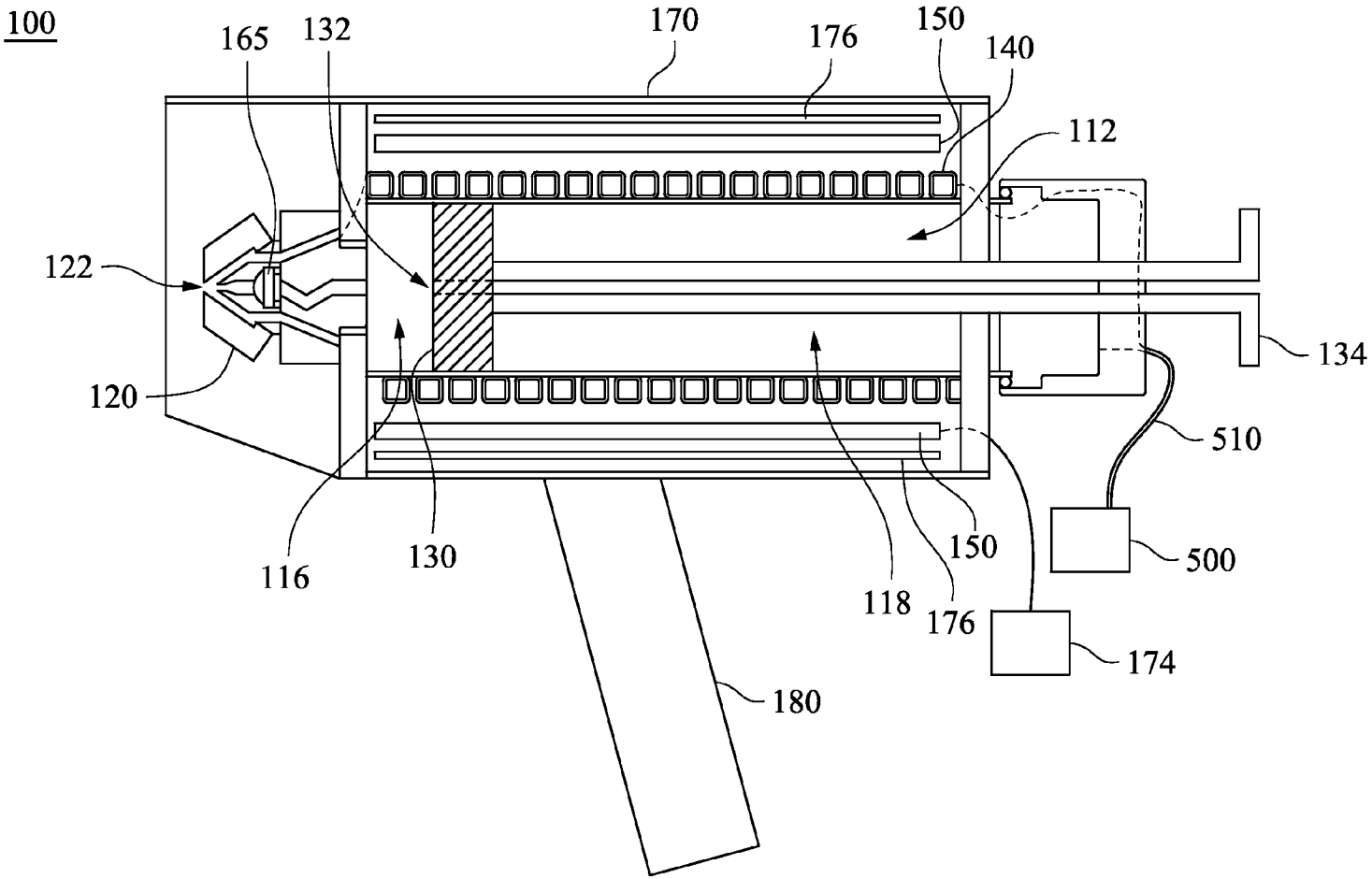
FIG. 6 is a cross-sectional view of the thermal spraying apparatus in FIG. 5.

FIG. 5 is a perspective view of a thermal spraying apparatus 100 according to a third embodiment of this invention. FIG. 6 is a cross-sectional view of the thermal spraying apparatus 100 in FIG. 5. The major difference between the present embodiment and the first embodiment is that the thermal spraying apparatus 100 according to the present embodiment further includes a pushrod 134. The pushrod 134 is connected to the piston 130 and extends outside the accommodating space 112. In practical applications, the pushrod 134 moves with the piston 130. Hence, the designer can be informed of the residual amount of the raw material, so as to replenish the raw material timely.

In addition, except for the rod-shaped raw material, powder row material or particle raw material may be adopted in the present embodiment. In greater detail, since air is in between the powder or particle raw material, the thermal spraying apparatus 100 may include an air passage 132 in some embodiments, as shown in FIG. 5 and FIG. 6. The air passage 132 passes through the piston 130 and the pushrod 134 and is in spatial communication with the front part 116 and an outside of the thermal spraying apparatus 100 to expel the air in between the raw material to the outside of the thermal spraying apparatus 100, so as to avoid intermittent spraying operations caused by the air in between the raw material. In greater detail, when the piston 130 pushes the raw material, the piston 130 will extrude the raw material located in the front part 116. The air in the raw material will be expelled to the outside of the thermal spraying apparatus 100 via the air passage 132 after the air in the raw material is extruded, so the unsmooth spraying operation will not occur.

According to the present embodiment, the temperature controller of the thermal spraying apparatus 100 may be an external temperature controller 174. The external temperature controller 174 is detachably and electrically connected to the heater 150 for controlling the temperature of the heater 150. In greater detail, the external temperature controller 174 according to the present embodiment may be located outside the housing 170 and the handheld grip 180. When the external temperature controller 174 detects that the temperature will soon be unduly high, it will actively control the heater 150 to stop raising temperature. When the external temperature controller 174 detects that the temperature will soon be unduly low, it will actively control the heater 150 to raise temperature.

Since other relevant structures and operation details are the same as those of the first embodiment, a description in this regard is not provided.

Fourth Embodiment

Figure 7:
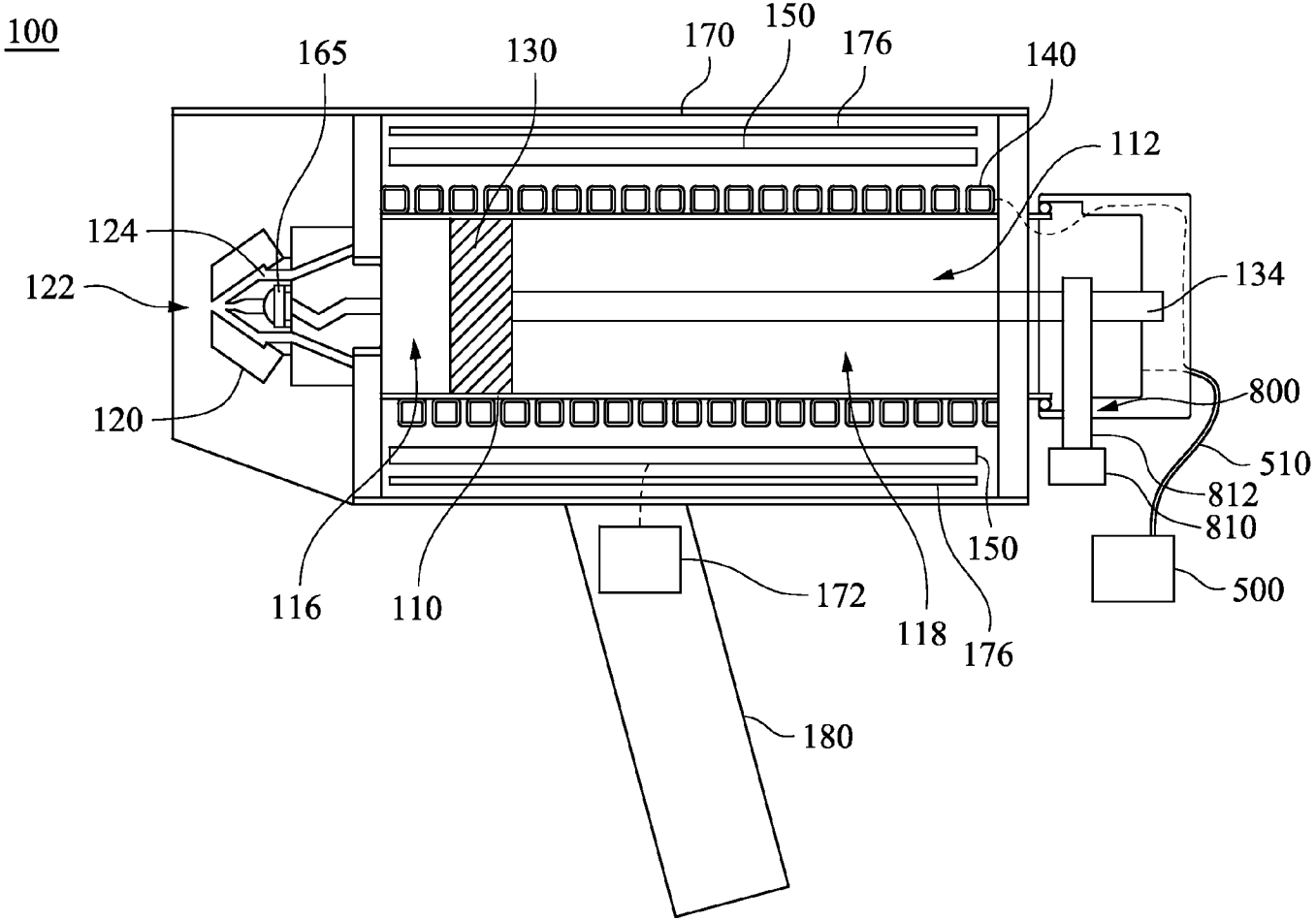
FIG. 7 is a cross-sectional view of a thermal spraying apparatus according to a fourth embodiment of this invention.

FIG. 7 is a cross-sectional view of a thermal spraying apparatus 100 according to a fourth embodiment of this invention. The major difference between the present embodiment and the third embodiment is that the thermal spraying apparatus 100 includes a piston control device 800. The piston control device 800 is configured to control the piston 130 to push the raw material at a constant speed so that the uneven spraying speed of the raw material, which in turn impacts the thermal spraying effect, is prevented. In greater detail, the piston control device 800 controls the piston 130 to move toward the nozzle 122 at a constant speed by the pushrod 134 so that the piston 130 is able to push the raw material in the front part 116 at a constant speed.

In some embodiments, the piston control device 800 includes a stepper motor 810. The stepper motor 810 has an output shaft 812. The output shaft 812 is connected to the pushrod 134 and the pushrod 134 is configured to control the piston 130 to move in the accommodating space 112 at a constant speed. For example, the pushrod 134 may be a guide screw. The output shaft 812 of the stepper motor 810 can be engaged with the guide screw. The guide screw can be driven to rotate when the output shaft 812 rotates, so as to push the piston 130.

Since other relevant structures and operation details are the same as those of the first embodiment, a description in this regard is not provided.

Fifth Embodiment

Figure 8A:
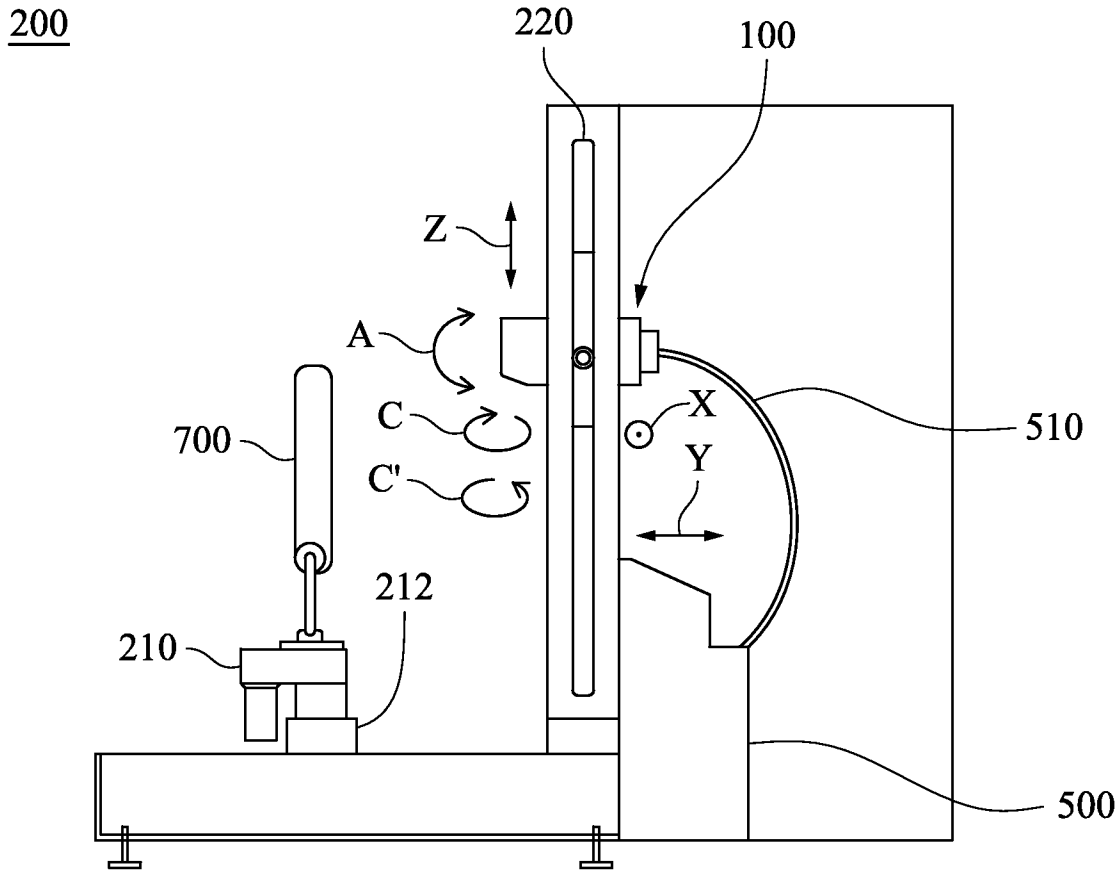
FIG. 8A is a schematic diagram of a thermal spraying system according to a fifth embodiment of this invention.
Figure 8B:
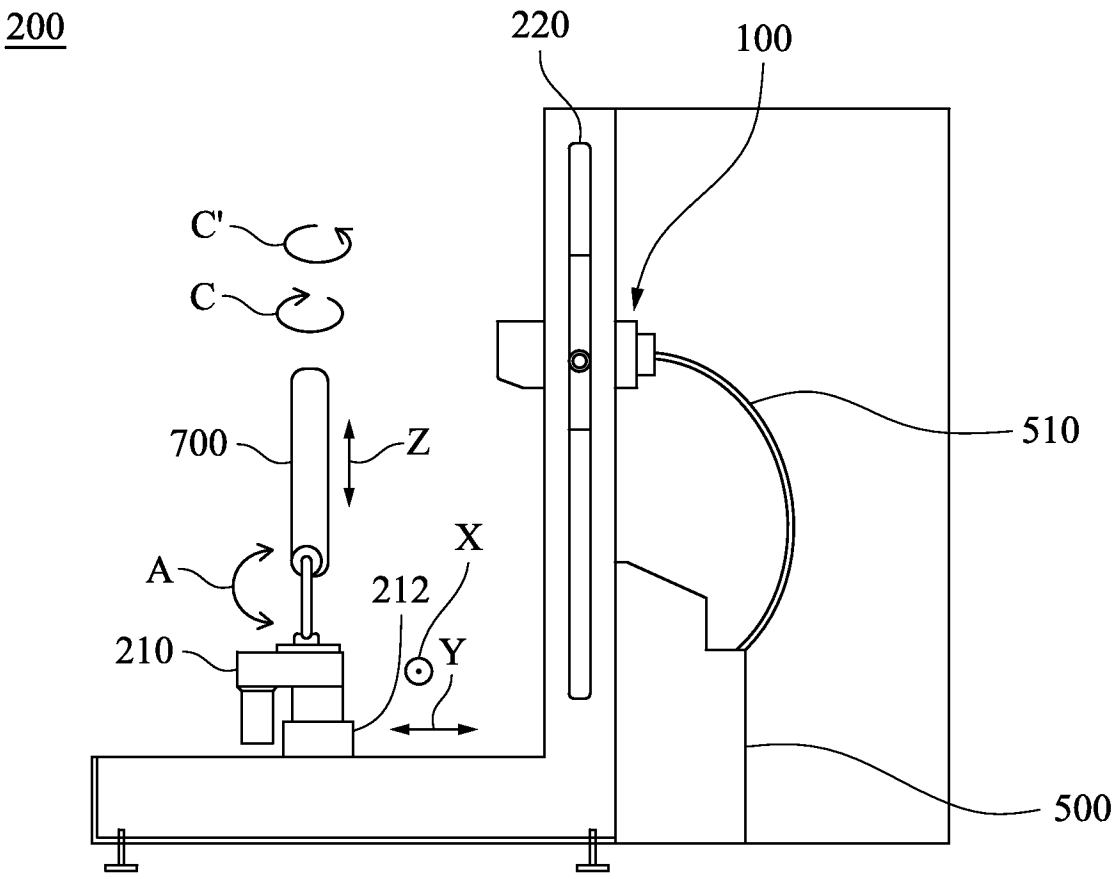
FIG. 8B is a schematic diagram of another thermal spraying system according to the fifth embodiment of this invention.
Figure 8C:
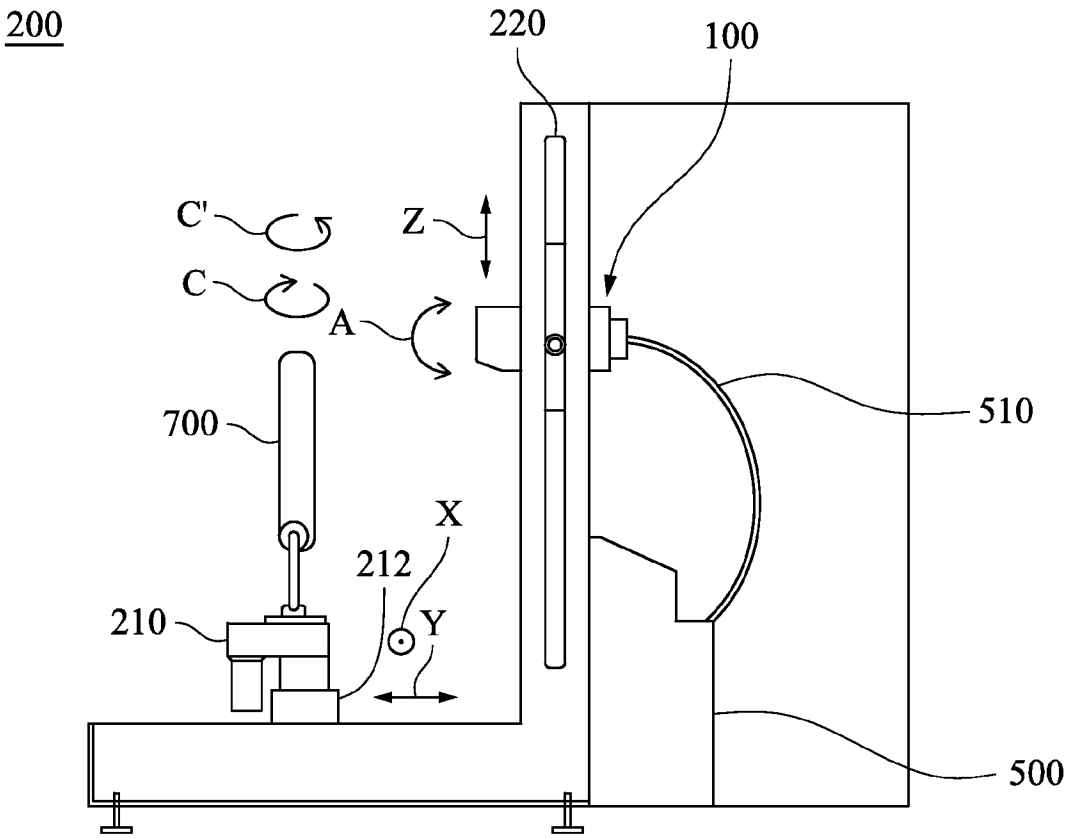
FIG. 8C is a schematic diagram of still another thermal spraying system according to the fifth embodiment of this invention.
Figure 9:
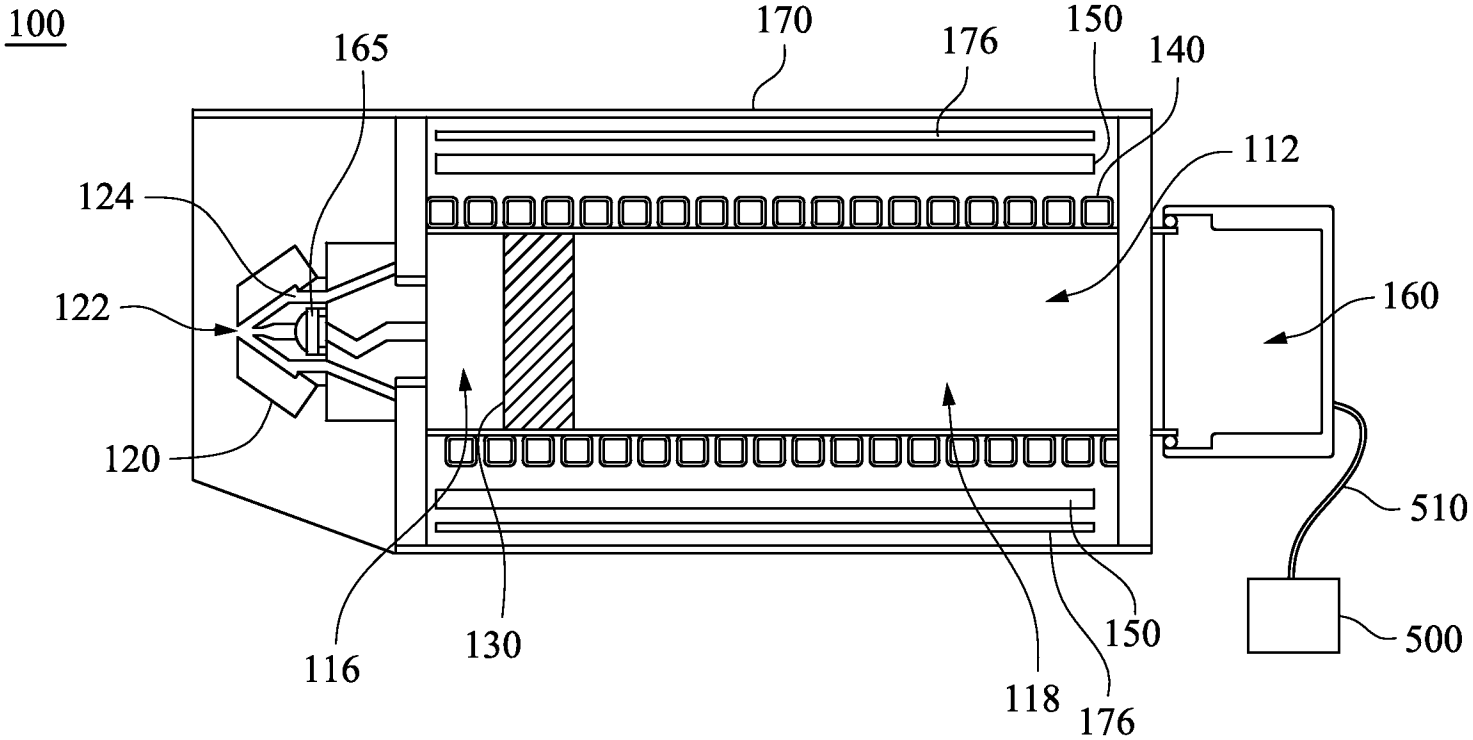
FIG. 9 is a cross-sectional view of the thermal spraying apparatus in FIG. 8A.

The thermal spraying apparatus 100 may also cooperate with the thermal spraying technology to form a thermal spraying system. A description is provided with reference to FIG. 8A and FIG. 9. FIG. 8A is a schematic diagram of a thermal spraying system 200 according to a fifth embodiment of this invention. FIG. 9 is a cross-sectional view of the thermal spraying apparatus 100 in FIG. 8A. The thermal spraying system 200 includes a fixing device 210, the thermal spraying apparatus 100, and a motion module. The fixing device 210 is configured to fix an object to be thermally sprayed 700. The thermal spraying apparatus 100 is configured to perform a thermal spraying operation to the object to be thermally sprayed 700. The motion module is configured to drive a relative motion between the thermal spraying apparatus 100 and the fixing device 210. For example, the motion module may include a thermal spraying motion device 220. The thermal spraying motion device 220 is connected to the thermal spraying apparatus 100 to allow the thermal spraying apparatus 100 to move in three dimensions relative to the motionless object to be thermally sprayed 700, such as dimension X, dimension Y, dimension Z, the rotation direction C, the reverse rotation direction C', the pitch direction A, or combinations of the three dimensions and the rotation directions, as shown in FIG. 8A. FIG. 8B is a schematic diagram of another thermal spraying system according to the fifth embodiment of this invention. In another embodiment, the thermal spraying apparatus 100 may be maintained static and the object to be thermally sprayed 700 moves in dimension X, dimension Y, dimension Z, the rotation direction C, the reverse rotation direction C', the pitch direction A, or combinations of the three dimensions and the rotation directions, as shown in FIG. 8B. A description is provided with reference to FIG. 8C. FIG. 8C is a schematic diagram of still another thermal spraying system according to the fifth embodiment of this invention. In still another embodiment, each of the thermal spraying apparatus 100 and the object to be thermally sprayed 700 can, as shown in FIG. 8C, move in dimension X, dimension Y, dimension Z, the rotation direction C, the reverse rotation direction C', the pitch direction A, or combinations of the three dimensions and the rotation directions so as to achieve a three-dimensional motion independent of each other to perform the thermal spraying operation. Three-dimensional motion methods can be based on designs of various mechanisms of the thermal spraying apparatus 100 and the object to be thermally sprayed 700 of the thermal spraying system 200. The motion methods provided by the above embodiment only serve as examples and are not intended for limiting the present invention. Those of ordinary skill in the art may flexibly select the motion methods of the thermal spraying apparatus 100 and the object to be thermally sprayed 700 as required by practical needs, so as to achieve reciprocal three-dimensional motion methods relative to each other, which are not limited to the embodiments of the present invention.

In other words, the motion module of the thermal spraying system 200 can further includes an object motion device 212. The object motion device 212 is connected to the fixing device 210 to allow the object to be thermally sprayed 700 to move in at least a second dimension relative to the thermal spraying apparatus 100. A first dimension and the second dimension are linearly independent of each other. Since the first dimension is linearly independent of the second dimension, the thermal spraying apparatus 100 is able to spay various positions on the object to be thermally sprayed 700 by the cooperation of the object motion device 212 and the thermal spraying motion device 220.

It should be understood that the above motion methods only serve as examples and are not intended for limiting the present invention. Those of ordinary skill in the art may flexibly select the motion methods of the thermal spraying apparatus 100 and the object to be thermally sprayed 700 as required by practical needs. For example, in some embodiments of the present invention, the object motion device 212 may be omitted, and the motions in various dimensions are independently achieved by the thermal spraying motion device 220.

As shown in FIG. 9, in the present embodiment, since the thermal spraying apparatus 100 is connected to the thermal spraying motion device 220 (see FIG. 8C), there is no necessity to operate in a handheld manner. Under such situations, the handheld grip 180 may be omitted. Of course, if in some situations, the handheld operation is expected to be retained, the handheld grip 180 can be included.

The present invention thermal spraying system 200 can be used to manufacture a variety of industrial products. For example, when the present invention thermal spraying system 200 is configured to manufacture vehicle seats, the object to be thermally sprayed 700 may be a seat body or a seat mold. The thermal spraying system 200 can thermally spray a cousin on the seat body or the seat mold. In addition, when the present invention thermal spraying system 200 is configured to manufacture uppers, the object to be thermally sprayed 700 may be a shoe last. The thermal spraying system 200 can thermally spray an upper on the shoe last.

Since other relevant structures and operation details are the same as those of the first embodiment, a description in this regard is not provided.

Sixth Embodiment

Figure 10A:
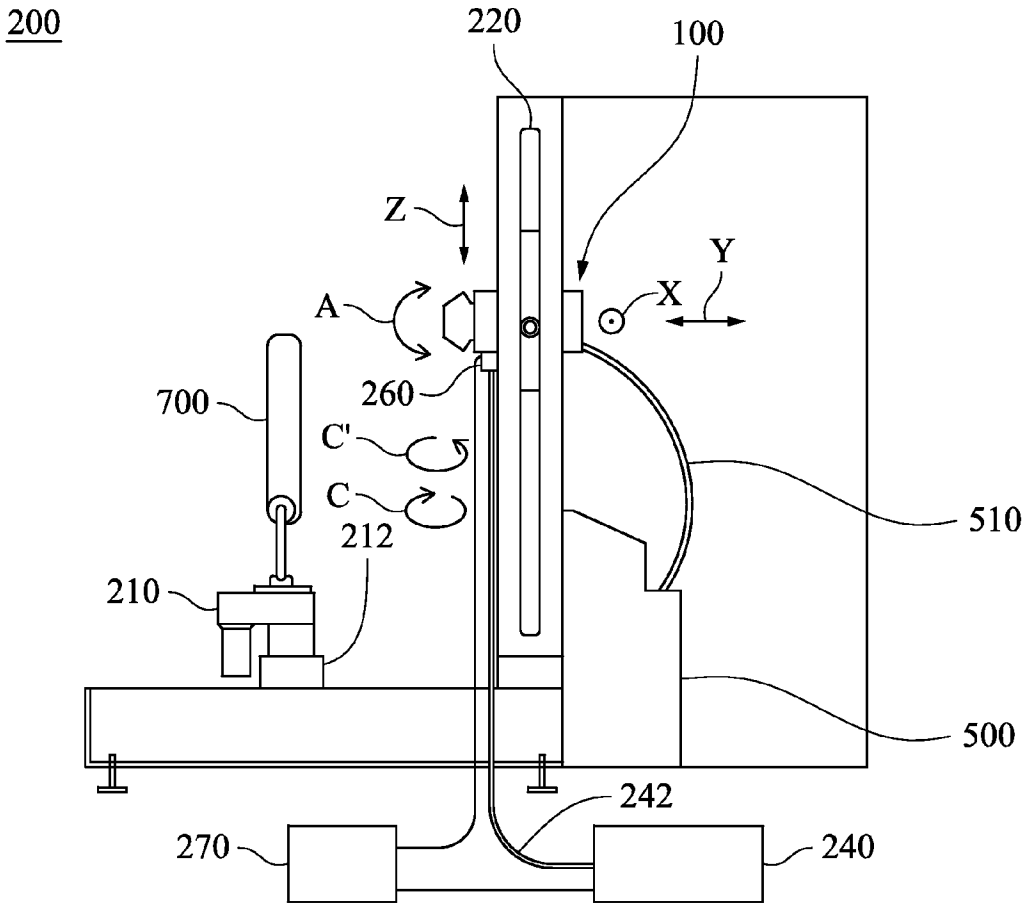
FIG. 10A is a schematic diagram of a thermal spraying system according to a sixth embodiment of this invention.
Figure 11:
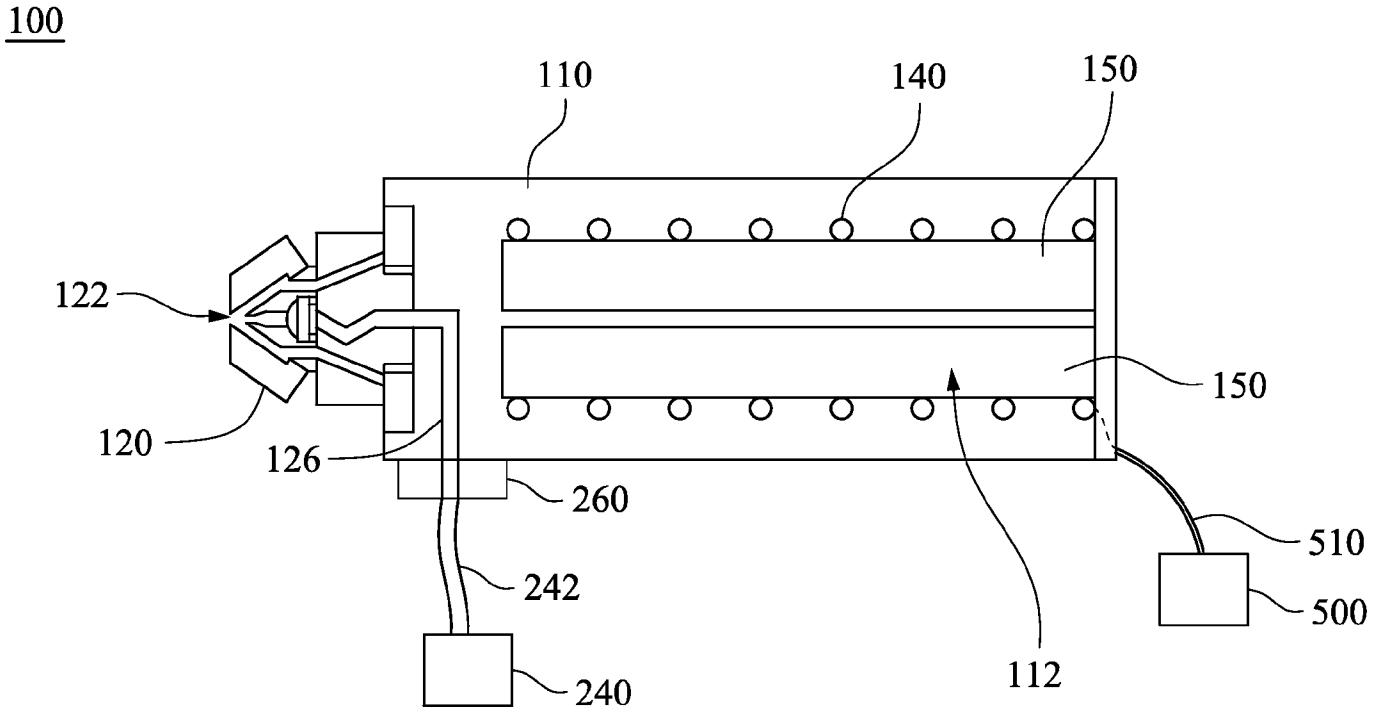
FIG. 11 is a cross-sectional view of the thermal spraying apparatus in FIG. 10A.

The present invention further provides another thermal spraying system. Similarly, the thermal spraying system also can move relative to the object to be thermally sprayed and perform a thermal spraying operation. A description is provided with reference to FIG. 10A and FIG. 11. FIG. 10A is a schematic diagram of a thermal spraying system 200 according to a sixth embodiment of this invention. FIG. 11 is a cross-sectional view of the thermal spraying apparatus 100 in FIG. 10A. As shown in FIG. 10A and FIG. 11, the major difference between the present embodiment and the fifth embodiment is that the thermal spraying system 200 according to the present embodiment can further include a raw material supplying device 240. The raw material supplying device 240 is configured to supply the raw material to the thermal spraying apparatus 100. The extrusion die 120 of the thermal spraying apparatus 100 is connected to the raw material supplying device 240. The nozzle 122 of the extrusion die 120 is in spatial communication with the raw material and the fluid, such that the fluid can carry the raw material to be sprayed out of the nozzle 122.

As compared with the third embodiment, the raw material supplying device 240 according to the present embodiment can continuously supply the raw material to the nozzle 122 without the necessity of manually replenishing the raw material to the thermal spraying apparatus 100. In the present embodiment, the foregoing raw material supplying device 240 may be an extruder. In addition, the raw material supplying device 240 has a raw material supplying pipe 242. The raw material supplying pipe 242 is connected to the thermal spraying apparatus 100. The raw material supplying pipe 242 is a flexible pipe. In such configuration, the thermal spraying apparatus 100 is able to move relative to the raw material supplying device 240. In other words, when the thermal spraying motion device 220 drives the thermal spraying apparatus 100 to move, the raw material supplying device 240 does not need to move together, thus reducing the load of the thermal spraying motion device 220.

The thermal spraying apparatus 100 can further include a switching valve 260. The switching valve 260 is connected between the raw material supplying device 240 and the nozzle 122. When the switching valve 260 is turned on, the raw material can be transported from the raw material supplying pipe 242 to the nozzle 122 via the switching valve 260 and a raw material passage 126. When the switching valve 260 is turned off, the raw material can not be transported to the nozzle 122 via the switching valve 260. As such, users can control whether the nozzle 122 sprays the raw material by controlling the switching valve 260. In practical applications, the foregoing switching valve 260 may be an electric control switching valve and/or a pneumatic switching valve.

In addition, the thermal spraying apparatus 100 may further include a synchronous device 270 according to the present embodiment. The synchronous device 270 is configured to control the switching valve 260 and the raw material supplying device 240 to operate simultaneously. That is, when the switching valve 260 is turned on, the raw material supplying device 240 is activated. When the switching valve 260 is turned off, the raw material supplying device 240 is deactivated.

Additionally, in the present embodiment, the helical pipe 140 surrounds the heater 150 so that the heater 150 can be configured to heat the fluid in the helical pipe 140. In greater detail, as compared with the previous embodiments, since the accommodating space 112 in the hollow pipe 110 no longer needs to accommodate the raw material, the manufacturer can selectively install the heater 115 in the accommodating space 112 in the hollow pipe 110 to further decrease the volume of the thermal spraying apparatus 100.

Figure 10B:
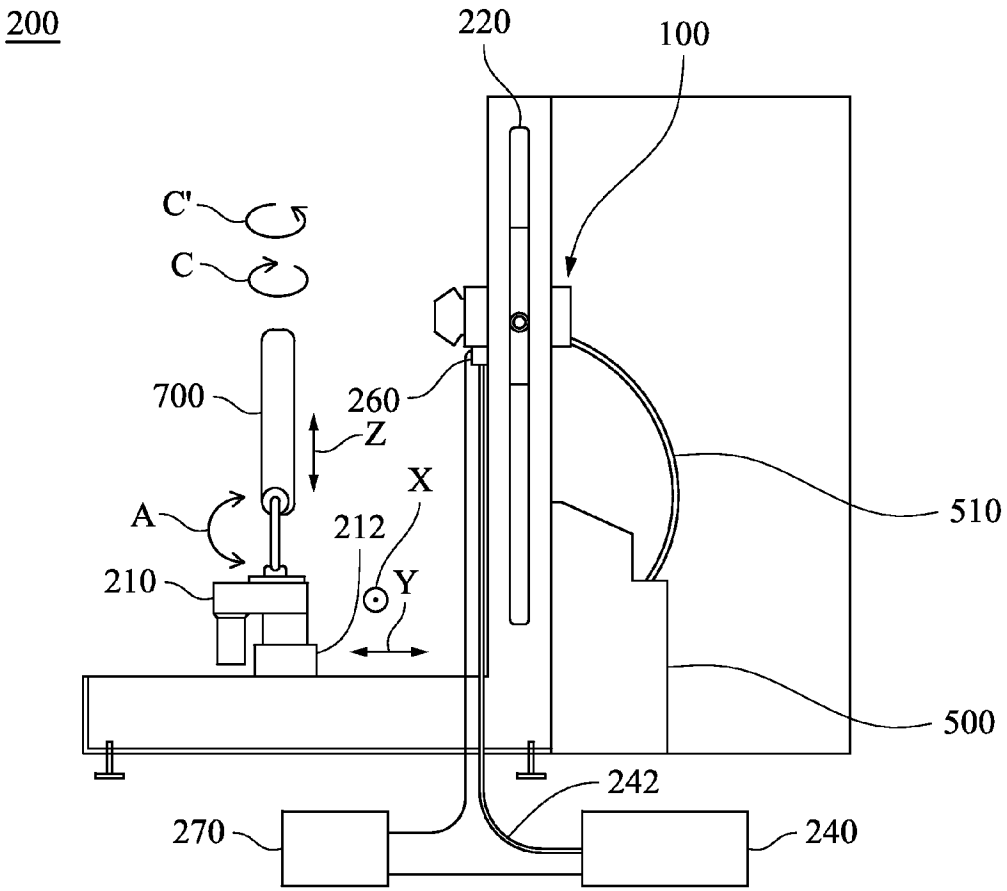
FIG. 10B is a schematic diagram of another thermal spraying system according to the sixth embodiment of this invention.
Figure 10C:
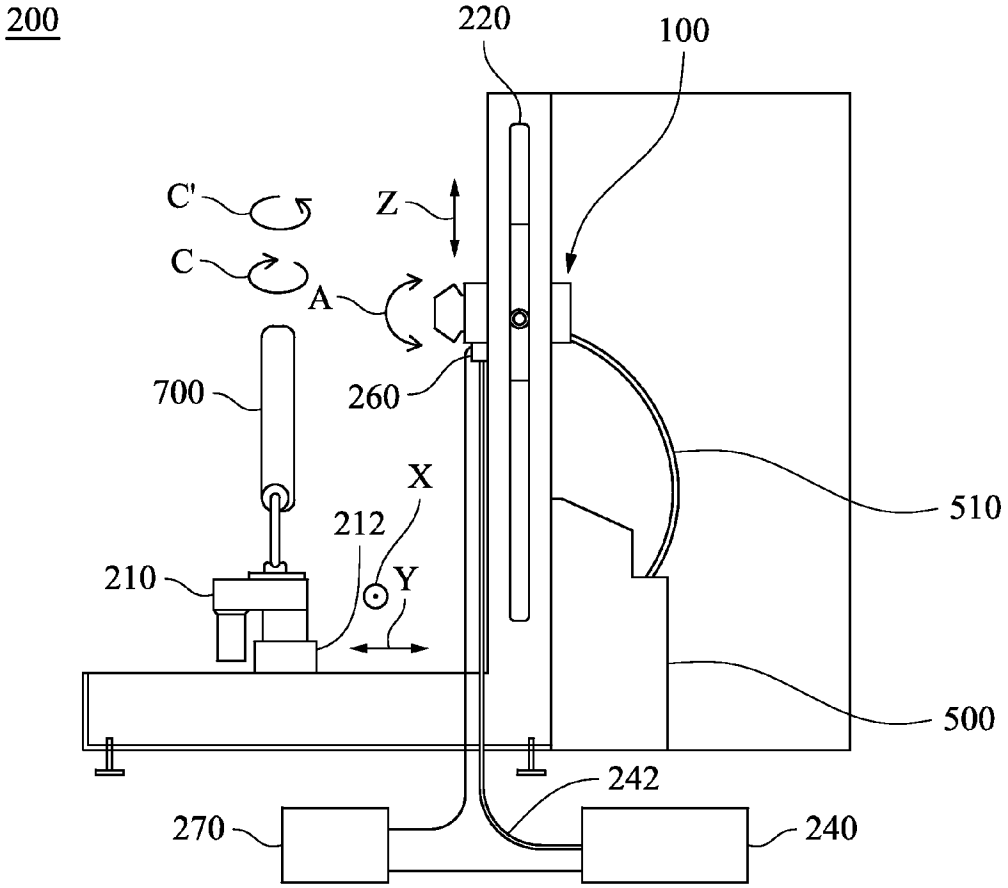
FIG. 10C is a schematic diagram of still another thermal spraying system according to the sixth embodiment of this invention.

Other relevant structures and operation details of the thermal spraying apparatus according to the present embodiment are similar to those of the fifth embodiment. In greater detail, the thermal spraying system 200 includes the fixing device 210, the thermal spraying apparatus 100, and the thermal spraying motion device 220. The fixing device 210 is configured to fix the object to be thermally sprayed 700. The thermal spraying apparatus 100 is configured to perform the thermal spraying operation to the object to be thermally sprayed. The thermal spraying motion device 220 is connected to the thermal spraying apparatus 100 and configured for allowing the thermal spraying apparatus 100 to move in three dimensions relative to the motionless object to be thermally sprayed 700, such as dimension X, dimension Y, dimension Z, the rotation direction C, the reverse rotation direction C', the pitch direction A, or combinations of the three dimensions and the rotation directions, as shown in FIG. 10A. A description is provided with reference to FIG. 10B. FIG. 10B is a schematic diagram of another thermal spraying system according to the sixth embodiment of this invention. In another embodiment, the thermal spraying apparatus 100 may be maintained static and the object to be thermally sprayed 700 moves in dimension X, dimension Y, dimension Z, the rotation direction C, the reverse rotation direction C', the pitch direction A, or combinations of the three dimensions and the rotation directions, as shown in FIG. 10B, to perform the thermal spraying operation. A description is provided with reference to FIG. 10C. FIG. 10C is a schematic diagram of still another thermal spraying system according to the sixth embodiment of this invention. In still another embodiment, each of the thermal spraying apparatus 100 and the object to be thermally sprayed 700 can, as shown in FIG. 10C, moves in dimension X, dimension Y, dimension Z, the rotation direction C, the reverse rotation direction C', the pitch direction A, or combinations of the three dimensions and the rotation directions so as to achieve a three-dimensional motion independent or each other to perform the thermal spraying operation. Three-dimensional motion methods can be based on designs of various mechanisms of the thermal spraying apparatus 100 and the object to be thermally sprayed 700 of the thermal spraying system 200. The motion methods provided by the foregoing embodiment only serve as examples and are not intended for limiting the present invention. Those of ordinary skill in the art may flexibly select the motion methods of the thermal spraying apparatus 100 and the object to be thermally sprayed 700 as required by practical needs to achieve reciprocal three-dimensional motion methods relative to each other, which are not limited to the embodiments of the present invention.

Seventh Embodiment

Figure 12:
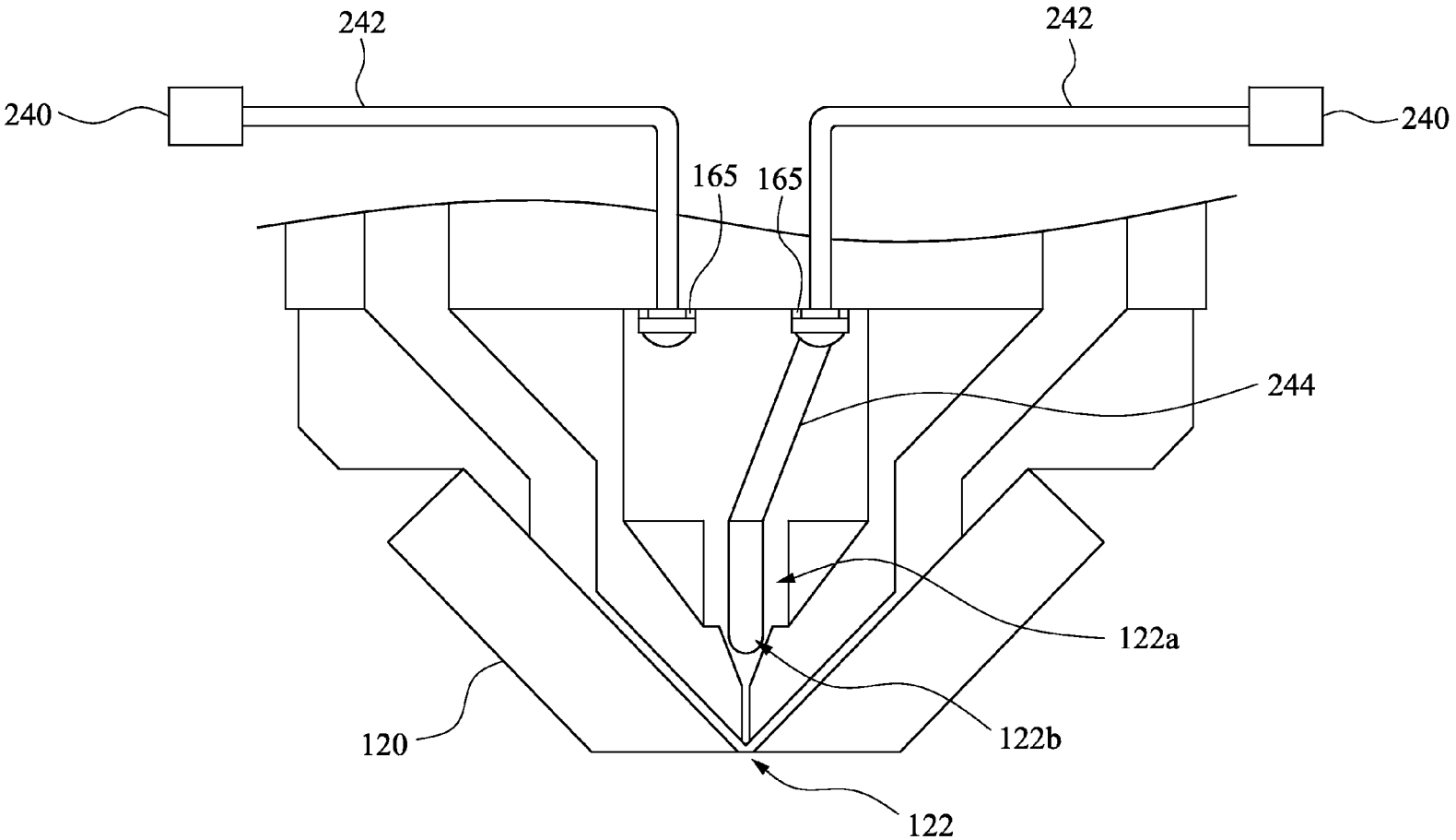
FIG. 12 is an enlarged view of an extrusion die of a thermal spraying system according to a seven embodiment of this invention.

The present invention still provides another thermal spraying system. FIG. 12 is an enlarged view of the extrusion die 120 of a thermal spraying system. As shown in FIG. 12, the major difference between the present embodiment and the sixth embodiment is that a number of the raw material supplying devices 240 is plural and a plurality of raw material supplying devices 240 are respectively configured to supply different raw materials to the nozzle 122. In this manner, spraying a multi-constituent raw material can be realized.

In greater detail, as shown in FIG. 12, the number of the raw material supplying devices 240 is two. Each of the two raw material supplying devices 240 includes the raw material supplying pipe 242. The nozzle 122 includes a first discharge port 122*a* and a second discharge port 122*b* being respectively in spatial communication with the raw material supplying pipes 242 of the two raw material supplying devices 240. Hence, the raw materials provided by the two raw material supplying devices 240 can be sprayed out respectively via the first discharge port 122*a* and the second discharge port 122*b* so as to realize multi-constituent raw material spraying.

In some embodiments, as shown in FIG. 12, the first discharge port 122*a* surrounds the second discharge port 122*b*. One of the raw material supplying devices 240 further includes a connecting pipe 244. The connecting pipe 244 is connected to the second discharge port 122*b*, so as to guide the raw material provided by the one of the raw material supplying devices 240 to be directly sprayed out from the second discharge port 122*b* without passing through the first discharge port 122*a*. Another one of the raw material supplying devices 240 does not include any connecting pipe and the raw material supplying pipe 242 of the another one of the raw material supplying devices 240 is in spatial communication with the first discharge port 122*a*, so as to directly spray the raw material from the first discharge port 122*a*.

In some embodiments, it is not necessary to adopt the plurality of raw material supplying devices 240 to realize the multi-constituent thermal spraying operation by using a multi-constituent raw material. Rather, a multi-constituent rod-shaped raw material can be placed in the front part 116 as shown in FIG. 9 to allow the multi-constituent rod-shaped raw material to melt into a molten state by the heater 150, and the molten multi-constituent rod-shaped raw material can be sprayed from the nozzle 120 when the piston 130 pushes the molten multi-constituent rod-shaped raw material.

Embodiments

In the following, several embodiments according to the present invention are described for illustrating that the thermal spraying apparatus 100 according to the above embodiments of the present invention can certainly configured to thermally spray fibers.

In the first embodiment, the employed thermal spraying apparatus 100 is the thermal spraying apparatus 100 shown in FIG. 2. The raw material is thermoplastic polyurethane (TPU), which has a brand name of Kutane 300 and is produced by Kuo Ching Chemical Co., Ltd. The temperature of the heater 150 is set to be 230° C. A pressure of the fluid supplying device 500 (in greater detail, air compressor) is set to be 5 kg/cm$^2$. Under such conditions, fibers thermally sprayed by the thermal spraying apparatus 100 have a fineness ranging from 2 μm to 5 μm.

In the second embodiment, the employed thermal spraying apparatus 100 is the thermal spraying apparatus 100 shown in FIG. 5. The raw material is polypropylene (PP), which has a melt flow index (MFI) of 1500 and is produced by Exxon Mobile Corp. The temperature of the heater 150 is set to be 200° C. The pressure of the fluid supplying device 500 (in greater detail, air compressor) is set to be 3 kg/cm$^2$. Under such conditions, fibers thermally sprayed by the thermal spraying apparatus 100 have the fineness ranging from 5 μm to 10 μm.

In the third embodiment, the employed thermal spraying apparatus 100 is the thermal spraying apparatus 100 shown in FIG. 5. The raw material is a mixture of polypropylene (PP) and polyolefin elastomer, which is produced by Idemitsu Kosan Co., Ltd and has a brand name of L-MODU. A mixing ratio is 50:50. Polypropylene has the melt flow index of 1500 and is produced by Exxon Mobile Corp. The temperature of the heater 150 is set to be 200° C. The pressure of the fluid supplying device 500 (in greater detail, air compressor) is set to be 4 kg/cm$^2$. Under such conditions, fibers thermally sprayed by the thermal spraying apparatus 100 have the fineness ranging from 10 μm to 15 μm.

In summary, the thermal spraying apparatus 100 according to the foregoing embodiments of the present invention can be operated independently in the handheld manner, or can cooperate with three-dimensional thermal spraying technology to form a thermal spraying system 200. The thermal spraying apparatus 100 can thermally spray fibers on any object. It is characterized by having no trace of sewing, process reduction, recyclable waste material, no solvent, and the products being lightweight, soft, comfortable, and breathable. Both the manufacturing and utilization satisfy eco-friendly principles and can be applied to fashion garments, UV protection, reflective material, fabric bonding, medical plaster and bandages, medical patches, medical supplies, packaging cushion materials, stage design, and heat-insulating acoustic wall.

Although the present invention has been described in considerable detail with reference to certain embodiments thereof, other embodiments are possible. Therefore, the spirit and scope of the appended claims should not be limited to the description of the embodiments contained herein.

It will be apparent to those skilled in the art that various modifications and variations can be made to the structure of the present invention without departing from the scope or spirit of the invention. In view of the foregoing, it is intended that the present invention cover modifications and variations of this invention provided they fall within the scope of the following claims and their equivalents.

What is claimed is:

1. A thermal spraying apparatus comprising:

a hollow pipe defining an accommodating space in the hollow pipe, the accommodating space being configured to accommodate a raw material;

an extrusion die connected with the hollow pipe, the extrusion die having a nozzle, the nozzle being in spatial communication with the accommodating space;

a piston being movably accommodated in the accommodating space to push the raw material to pass through the nozzle;

a helical pipe surrounding the hollow pipe, an end of the helical pipe being connected to the nozzle;

a fluid supplying device connected to another end of the helical pipe; and a heater enclosing the helical pipe and the hollow pipe for heating the helical pipe and the accommodating space.

2. The thermal spraying apparatus of claim 1, further comprising:

a propulsion passage, the accommodating space being divided into a front part closer to the nozzle and a back part farther from the nozzle by the piston, an end of the propulsion passage being connected to the fluid supplying device, another end of the propulsion passage being in spatial communication with the back part so that fluid provided by the fluid supplying device is able to push the piston to move toward the nozzle.

3. The thermal spraying apparatus of claim 2, further comprising:

a pressure controller for controlling a pressure of the fluid provided by the fluid supplying device so that the closer the piston is to the nozzle, the lower pressure the fluid has.

4. The thermal spraying apparatus of claim 1, wherein the accommodating space is divided into a front part closer to the nozzle and a back part farther from the nozzle by the piston, the piston has an air passage in the piston, the air passage is in spatial communication with the front part and an outside of the thermal spraying apparatus.

5. The thermal spraying apparatus of claim 1, further comprising:

a pushrod connected to the piston and extending outside the accommodating space.

6. The thermal spraying apparatus of claim 1, further comprising:

a piston control device for controlling the piston to push the raw material at a constant speed.

7. The thermal spraying apparatus of claim 6, further comprising a pushrod connected to the piston, the piston control device comprising a stepper motor, an output shaft of the stepper motor being connected to the push rod so as to control the piston to move in the accommodating space at a constant speed by the pushrod.

8. The thermal spraying apparatus of claim 1, further comprising:

a housing at least enclosing the hollow pipe, the helical pipe, and the heater; and a handheld grip connected to the housing.

9. The thermal spraying apparatus of claim 8, wherein the housing extends to surround the nozzle.

10. The thermal spraying apparatus of claim 1, further comprising:

a temperature controller electrically connected to the heater for controlling a temperature of the heater.

11. The thermal spraying apparatus of claim 1, further comprising:

a heat-insulating element enclosing the heater, the helical pipe, and the hollow pipe.

* * * * *